US010494885B2

(12) United States Patent
Lehr et al.

(10) Patent No.: US 10,494,885 B2
(45) Date of Patent: Dec. 3, 2019

(54) MUD PULSE TELEMETRY WITH CONTINUOUS CIRCULATION DRILLING

(71) Applicant: BAKER HUGHES INCORPORATED, Houston, TX (US)

(72) Inventors: Joerg Lehr, Lower Saxony (DE); Christian Fulda, Sehnde (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 14/961,364

(22) Filed: Dec. 7, 2015

(65) Prior Publication Data

US 2016/0084077 A1 Mar. 24, 2016

Related U.S. Application Data

(63) Continuation-in-part of application No. 13/760,817, filed on Feb. 6, 2013, now Pat. No. 9,249,648.

(51) Int. Cl.
*E21B 23/10* (2006.01)
*E21B 21/10* (2006.01)
(Continued)

(52) U.S. Cl.
CPC ..... *E21B 21/10* (2013.01); *E21B 21/08* (2013.01); *E21B 21/103* (2013.01); *E21B 34/06* (2013.01);
(Continued)

(58) Field of Classification Search
CPC ..... E21B 47/18; E21B 17/16; E21B 17/18; E21B 17/028; E21B 17/023; E21B 21/08;
(Continued)

(56) References Cited

U.S. PATENT DOCUMENTS 1,491,986 A 4/1924 Greene
2,102,555 A 12/1937 Dyer
(Continued)

FOREIGN PATENT DOCUMENTS

AU 2011293656 A1 1/2013
WO 2012010480 A2 1/2012
WO 20120126321 1/2012

OTHER PUBLICATIONS

PCT/US2014/015041—International Search Report dated Jun. 3, 2014.

*Primary Examiner* — Brad Harcourt
(74) *Attorney, Agent, or Firm* — Mossman, Kumar & Tyler, PC

(57) ABSTRACT

A system for performing a wellbore operation while a fluid circulates in a wellbore may include a string, a fluid circulation system, a control device, The string may include at least a first tubular section and a second tubular section. The a fluid circulating system has a first fluid path and a second fluid path, wherein only one of the first fluid path and the second fluid path circulate the fluid into the string at a specified time. The control device selects one of the first or second fluid path through which to convey the fluid into the string, at least one signal generator in hydraulic communication with the circulating fluid, the at least one signal generator configured to impart at least one pressure signal into the circulating fluid, and at least one pressure transducer in pressure communication with the circulating fluid and configured to detect the imparted at least one pressure signal, wherein the at least one signal generator and the at least one pressure transducer form a communication link, the communication link configured to convey information between at least two locations along a flow path of the circulating drilling fluid, irrespective of the fluid path selected by the control device to convey the fluid into the drill string.

13 Claims, 3 Drawing Sheets

(51) Int. Cl.

| | |
|---|---|
| ***E21B 34/06*** | (2006.01) |
| ***E21B 47/12*** | (2012.01) |
| ***E21B 21/08*** | (2006.01) |
| ***E21B 47/18*** | (2012.01) |
| *E21B 21/00* | (2006.01) |

(52) U.S. Cl.
CPC ..... *E21B 47/12* (2013.01); *E21B 47/18* (2013.01); *E21B 21/106* (2013.01); *E21B 2021/006* (2013.01)

(58) Field of Classification Search
CPC ... E21B 34/06; E21B 21/103; E21B 2021/006
See application file for complete search history.

(56) References Cited

U.S. PATENT DOCUMENTS

| | | | |
|---|---|---|---|
| 2,158,356 | A | 5/1939 | Dyer |
| 2,522,444 | A | 9/1950 | Grable |
| 3,078,921 | A | 2/1963 | Edwards |
| 3,298,385 | A | 1/1967 | Jackson et al. |
| 4,310,050 | A | 1/1982 | Bourgoyne, Jr. |
| 4,448,267 | A | 5/1984 | Crawford, III et al. |
| 4,646,844 | A | 3/1987 | Roche et al. |
| 4,768,598 | A | 9/1988 | Reinhardt |
| 5,332,044 | A | 7/1994 | Dallas et al. |
| 5,584,343 | A | 12/1996 | Coone |
| 6,253,861 | B1 | 7/2001 | Carmichael et al. |
| 6,315,051 | B1 | 11/2001 | Ayling |
| 6,412,554 | B1 | 7/2002 | Allen et al. |
| 6,581,692 | B1 | 6/2003 | Koch et al. |
| 6,591,916 | B1 | 7/2003 | Ayling |
| 6,688,394 | B1 | 2/2004 | Ayling |
| 6,739,397 | B2 | 5/2004 | Ayling |
| 6,938,709 | B2 | 9/2005 | Juhasz et al. |
| 7,028,787 | B2 | 4/2006 | Allen et al. |
| 7,107,875 | B2 | 9/2006 | Haugen et al. |
| 7,134,489 | B2 | 11/2006 | Van Riet |
| 7,188,683 | B2 | 3/2007 | Ayling |
| 7,252,151 | B2 | 8/2007 | Ayling |
| 7,281,582 | B2 | 10/2007 | Robichaux et al. |
| 7,322,418 | B2 | 1/2008 | Ayling |
| 7,350,587 | B2 | 4/2008 | Springett et al. |
| 7,413,008 | B2 | 8/2008 | Basso et al. |
| 7,510,006 | B2 | 3/2009 | Juhasz et al. |
| 8,151,904 | B2 | 4/2012 | Krueger et al. |
| 9,057,235 | B2 | 6/2015 | Blue et al. |
| 2003/0066650 | A1 | 4/2003 | Fontana et al. |
| 2005/0098349 | A1 | 5/2005 | Krueger et al. |
| 2006/0254822 | A1 | 11/2006 | Ayling et al. |
| 2006/0278434 | A1 | 12/2006 | Calderoni et al. |
| 2007/0137898 | A1* | 6/2007 | Virally ..... E21B 21/08 175/61 |
| 2009/0025930 | A1 | 1/2009 | Iblings et al. |
| 2009/0114398 | A1 | 5/2009 | Buytaert et al. |
| 2011/0067923 | A1 | 3/2011 | Leuchtenberg |
| 2011/0308860 | A1* | 12/2011 | deBoer ..... E21B 17/00 175/57 |
| 2012/0181043 | A1 | 7/2012 | Patel |
| 2012/0205122 | A1 | 8/2012 | Peter et al. |
| 2013/0014991 | A1 | 1/2013 | Leuchtenberg |
| 2013/0014993 | A1 | 1/2013 | Jeffries |
| 2013/0047696 | A1 | 2/2013 | Rasmus et al. |
| 2014/0216816 | A1 | 8/2014 | Lehr |

* cited by examiner

MUD PULSE TELEMETRY WITH CONTINUOUS CIRCULATION DRILLING

CROSS-REFERENCE TO RELATED APPLICATIONS

This application is a continuation-in-part of U.S. application Ser. No. 13/760,817, filed Feb. 6, 2013, the entire disclosure of which is incorporated herein by reference in its entirety.

BACKGROUND OF THE DISCLOSURE

1. Field of the Disclosure

This disclosure relates generally to mud pulse telemetry systems for oilfield systems.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." During drilling, surface personnel may "break" the drill in order to add or remove a joint or other piece of equipment. The process of breaking and making-up the drill string may interrupt communication links used by conventional drilling systems.

In aspects, the present disclosure provides communication links and telemetry systems that provide communication even during such interruptions.

SUMMARY OF THE DISCLOSURE

In aspects, the present disclosure provides a system for performing a wellbore operation while a fluid circulates in a wellbore. The system may include a string comprising at least a first tubular section and a second tubular section, each tubular section configured to be disconnected from the string; a fluid circulating system circulating fluid through at least a part of the string; a continuous circulation device comprising at least a first fluid path and a second fluid path, wherein only one of the first fluid path and the second fluid path circulate the fluid into the string at a specified time; a control device configured to select one of the first and second fluid path through which to convey the fluid into the string; at least one signal generator in hydraulic communication with the circulating fluid, the at least one signal generator configured to impart at least one pressure signal into the circulating fluid; and at least one pressure transducer in pressure communication with the circulating fluid and configured to detect the imparted at least one pressure signal. The at least one signal generator and the at least one pressure transducer form a communication link, the communication link being configured to convey information between at least two locations along a flow path of the circulating drilling fluid, irrespective whether the first fluid path or the second fluid path is selected by the control device to convey the fluid into the drill string.

In aspects, the present disclosure provides a method for performing a wellbore operation while a fluid circulates in a wellbore. The method includes conveying a string into the wellbore, the string comprising at least a first tubular section and a second tubular section, each tubular section configured to be disconnected from the string; circulating fluid through at least a part of the string using a fluid circulating system, wherein the fluid circulation system includes a continuous circulation device comprising at least a first fluid path and a second fluid path, wherein only one of the first fluid path and the second fluid path circulate the fluid into the string at a specified time; selecting one of the first and second fluid path through which to convey the fluid into the string using a control device; imparting at least one pressure signal into the circulating fluid using at least one signal generator in hydraulic communication with the circulating fluid; and detecting the imparted at least one pressure signal using at least one pressure transducer in pressure communication with the circulating fluid. The at least one signal generator and the at least one pressure transducer form a communication link, the communication link being configured to convey information between at least two locations along a flow path of the circulating drilling fluid, irrespective whether the first fluid path or the second fluid path is selected by the control device to convey the fluid into the drill string.

Examples of certain features of the disclosure have been summarized in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide a mud pulse telemetry system that can function continuously even when a drill string is "broken" to add or remove equipment. Generally, a mud pulse communication system uses pressure pulses transmitted along a column of drilling fluid (or "mud") to transmit data. The pressure pulses may be generated by a signal generator such as a valve, pulser, or pulse wave generator. Conventionally, an encoder generates a signal, e.g., by either restricting mud flow or venting drilling fluid, and a decoder detects the signal.

Illustrative embodiments of the present disclosure use a mud pulse telemetry system in conjunction with a continuous circulation system in order to provide continuous or "real time" signal communication between the surface and one or more downhole locations. The system may use a drill string that includes one or more signal conveying and pressure sensitive devices that cooperate with corresponding devices on the surface to continuously detect transmitted pressure pulses. In one embodiment, at least a part of the signal conveying and pressure sensitive devices may be integrated into the flow diverters used with a continuous circulation system that circulates drilling fluid in the well. These and other embodiments are discussed in greater detail below.

Figure 1:
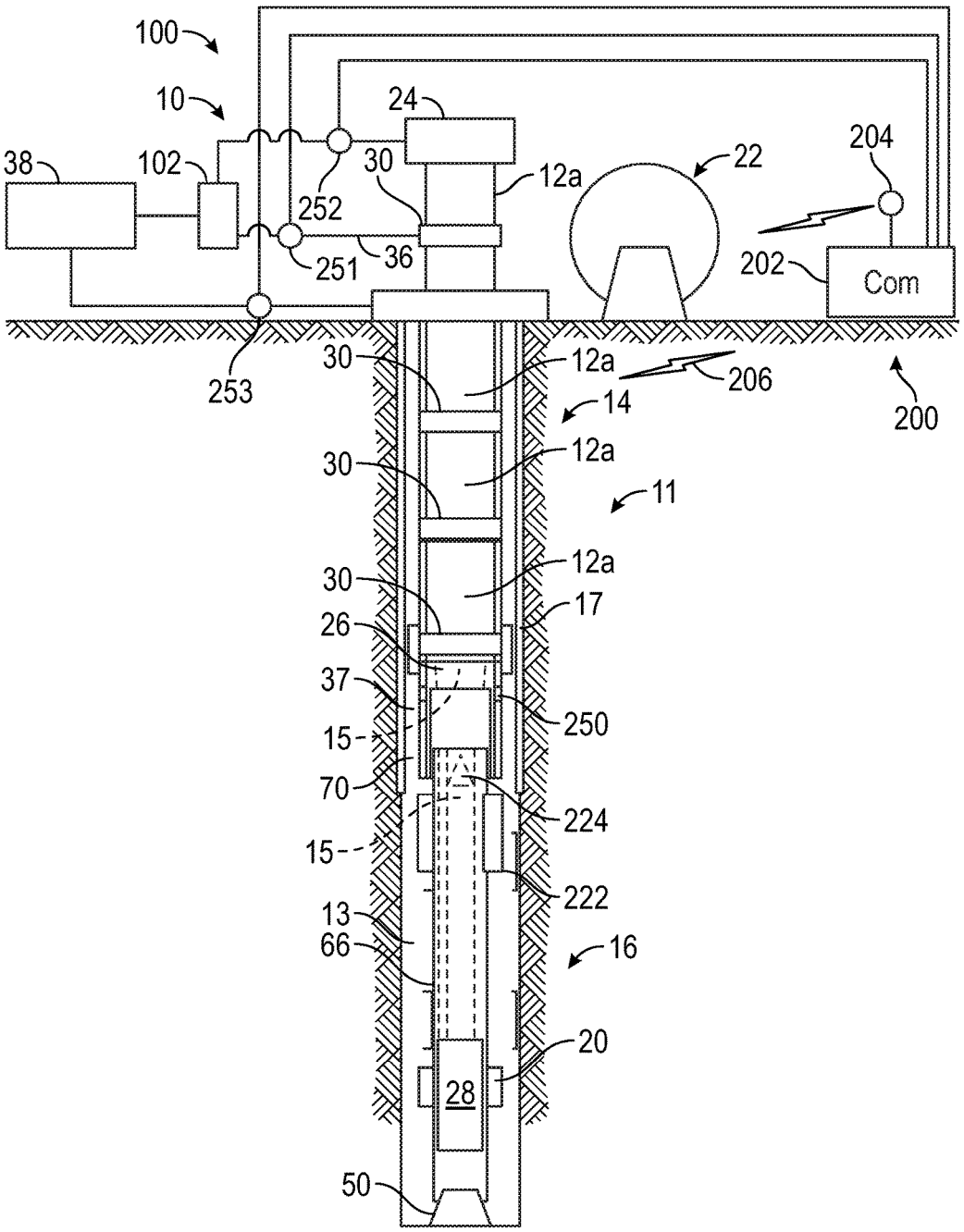
FIG. 1 schematically illustrates an exemplary wellbore construction system made in accordance with one embodiment of the present disclosure.

Referring initially to FIG. 1, there is shown a system 10 in accordance with one embodiment of the present disclosure. The system 10 includes a drill string 11 and a bottom-hole assembly (BHA) 20 suspended from a rig floor 13. In one embodiment, the drill string 11 may be made up of a section of rigid tubulars 14 (e.g., jointed tubular). In other embodiments, the drill string 11 may be made up of a rigid tubular section 14 and a non-rigid tubular section 16 (e.g., coiled tubing). As used herein, the term rigid and non-rigid are used in the relative sense to indicate that the sections 14 and 16 exhibit different responses to an applied loading. For instance, an applied torque that a jointed tubular can readily transmit may cause coiled tubing to fail. In one sense, a non-rigid tubular may be a continuous tubular that may be coiled and uncoiled from a reel or drum 22 (i.e., 'coilable') whereas a rigid tubular section may include segmented joints that may be organized in pipe stands 12*a* and may be manipulated by a top drive 24. The system 10 may also include rotary power devices 26, 28 (e.g., mud motors, electric motors, turbines for rotating one or more portions of the drill string 11, etc.). Rotary power for the drill bit 50 may be generated by a rotary power device 26 such as a motor at a connection between the rigid section 14 and the non-rigid section 16, a near bit motor 28, and/or the surface top drive 24.

Figure 2:
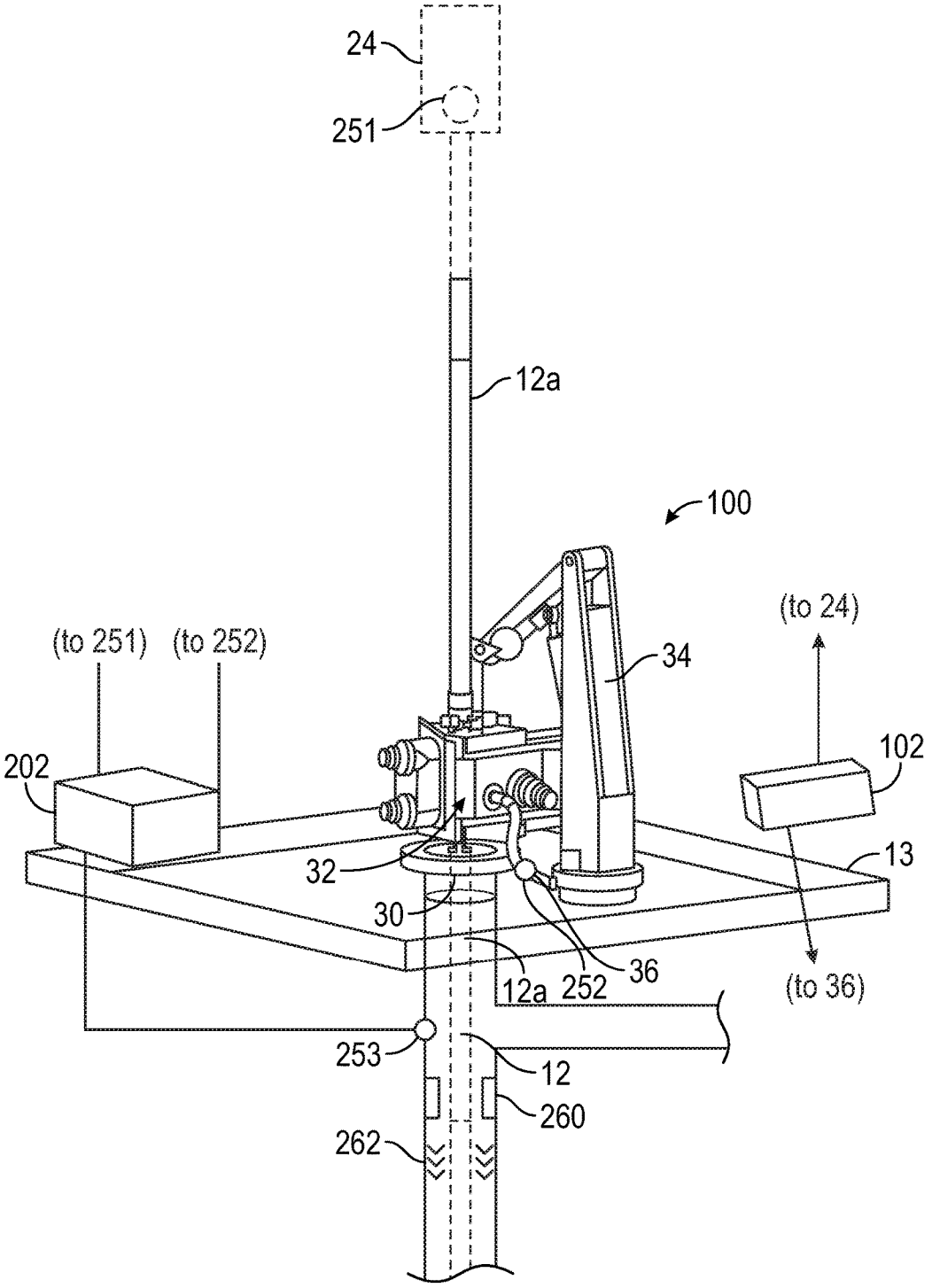
FIG. 2 schematically illustrates a continuous circulation system that may be used with the FIG. 1 system.

Referring now to FIG. 2, the system 10 includes a continuous circulation system 100 (CCS 100) that maintains continuous drill mud circulation in the drill string 11 as jointed connections are made up or broken in or between the rigid or non-rigid tubular section 14 or 16. In order to make up or break the drill string 11, a pipe stand 12*a* or a non-rigid tubular section 16 must be physically coupled or decoupled from the drill string 11. This physical decoupling ordinarily requires prevention of fluid circulation in the drill string 11 because the drilling fluid would spill through the physical gap separating the pipe stand 12*a* or the non-rigid tubular 16 and the remainder of the drill string 11. The CCS 100 allows maintaining fluid circulation while a pipe stand 12*a* or a non-rigid tubular section 16 is physically decoupled from the remainder of the drill string 11. The CCS 100 may include a flow diverter control device 32, an arm 34, a fluid line 36, and a manifold 102. During operation, the CCS 100 uses the manifold 102 to selectively direct drilling fluid to either the top drive 24 or the flow diverters 30 that interconnect the non-rigid tubular sections 16 or the pipe stands 12*a* of the rigid tubular section 14 of the remainder of the drill string 11. Thus, two flow paths are can be selected for conveying fluid into the drill string 11.

For example, during drilling, the manifold 102 directs drilling fluid into the top drive 24. To add a pipe stand 12*a*, drilling is stopped and the arm 34 moves the flow diverter control device 32 into engagement with a flow diverter 30 on top of the drill string 11. Valves are activated internal to the flow diverter 30 that block axial flow from top drive 24 and allow radial flow from and to the flow diverter control device 32. Thereafter, the manifold 102 switches drilling fluid flow from the top drive 24 to the fluid line 36, which flows drilling fluid from the source 38 to the flow diverter control device 32. The flow diverter control device 32 supplies the flow diverter 30 with pressurized fluid. The top drive 24 (FIG. 1) is now isolated from the drill string 11 and can be disconnected from the rigid section 14. Thus, drilling fluid is continuously supplied to the wellbore 13 even when the drill string 11 is not connected to the top drive 24. That is, the physical decoupling and resulting gap between the top drive 24 and the drill string 11 does not prevent drilling fluid from continuing to flow in the drill string 11. After disconnection of the top drive 24, a new pipe stand 12*a* or other equipment may be added to the drill string 11, the top drive 24 may be reconnected to the drill string 11, and the flow diverter control device may be disconnected from the flow diverter 30 after valves are adjusted to re-establish the fluid flow from the top drive 24 to the BHA 20 to allow drilling down another pipe stand 12*a*.

Figure 3:
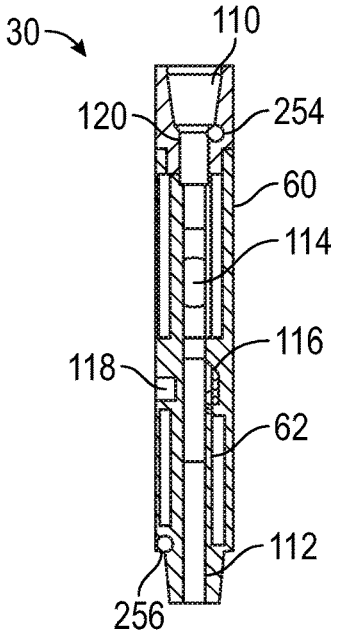
FIG. 3 schematically illustrates a flow diverter that may be used with the continuous circulation system of FIG. 2.

Referring now to FIG. 3, the flow diverter 30 includes an upper end 110 and a lower end 112. The flow diverter 30 may be fitted with flow control devices that allow fluid communication to the lower end 112 via either the upper end 110 or a radial/lateral opening. In one embodiment, the flow diverter 30 may include an upper circulation valve 114, a lower circulation valve 116, and an inlet 118. The upper circulation valve 114 selectively blocks flow along a bore 120 connecting the upper and lower ends 110, 112. The lower circulation valve 116 selectively blocks flow between the bore 120 and the inlet 118. The flow diverter control device 32 (FIG. 2) may include an upper valve actuator (not shown) that can shift the upper circulation valve 114 between an open and a closed position and a lower valve actuator (not shown) that can shift the lower circulation valve 116 between an open and a closed position. It should be appreciated that the CCS 100 has two separate fluid paths that can independently circulate drilling fluid into the drill string 11 (FIG. 1). The first fluid path is formed when the upper circulation valve 114 is open and the lower circulation valve 116 is closed. In this axial flow path, drilling fluid flows along the bore 120 from the upper end 110 to the lower end 112. The second fluid path is formed when the upper circulation valve 114 is closed and the lower circulation valve 116 is open. In this radial or lateral flow path, the drilling fluid flows along from the line 36 (FIG. 2), across the inlet 118, into the bore 120, and down to the lower end 112.

In one non-limiting embodiment, the flow diverter 30 may also be configured to convey signals along the wellbore 13 (FIG. 1). The signals may be conveyed in either the uphole or downhole direction. The signals may be encoded with information from sensor downhole or on surface such as for monitoring downhole pressure conditions or instructions for activating, deactivating, or controlling wellbore equipment such as equipment used to manage one or more pressure parameters. In one embodiment, the flow diverter 30 may include a short-hop telemetry module (not shown) that includes a signal relay device 60 energized by a power source 62. The signal relay device 60 may be embedded in the flow diverter 30 or fixed to the flow diverter 30 in any other suitable manner. The signal relay device 60 includes a suitable transceiver for receiving and transmitting data signals. For example, the signal relay device 60 can include an antenna arrangement through which electromagnetic signals are sent and received through a short hop communication link. One non-limiting embodiment may include radio frequency (RF) signals. The signal relay device 60 may be a component of a one-way or a two-way telemetry system that can transmit signals (data and/or control) to the surface and/or downhole. In an exemplary short-hop telemetry system, data is transmitted from one relay point to an immediately adjacent relay point, or a relay point some distance away. In other embodiments, other waves may be used to transmit signals, e.g., acoustical waves, pressure pulses, etc.

Transmission of pressure waves as arrays enables communication with all signal relay devices 30 and BHA modules along the entire drill-string at different points of time. Generation, repeating or magnification of the pulse pressure waves can be performed with positive or negative fluid displacement values. Some embodiments use battery or energy harvesting systems to drive pressure wave generating modules like piezo actuated pistons or membranes, or mud sirens, which are embedded in or connected to flow diverters 30 that include signal relay devices 60.

The transmission of magnified pressure signal arrays, utilizing interference with other signal relay devices along the entire drill-string at about the same point of time forms an Interference Magnified Array System (IMARYS). U.S. Pat. No. 7,230,880 shows an independent working power and communication module that may be used as an interfering device and link between the pressure wave generator on surface 262 and other modules of the BHA.

Time synchronization of modules may be achieved by the atomic clock utilization. Generation or disturbance of interference may be used to transmit information. Some embodiments use switching between signal downlink and signal uplink transmission frequency at interference points to simplify the system. Another arrangement involves working with interfering pressure wave pairs (or triples, or more) traveling along the drill string, repeating signal to transmit at different point of times (repeating signal at least ones while traveling DH or UpHole). Built-in pressure sensors receiving signal close by interfering pair and generating an interfering pair with the next reachable signal relay device unit (s) after a "hand shake."

Referring back to FIG. 1, a communication system 200 uses the signal relay devices 60 (FIG. 3) as part of a communication link with downhole equipment positioned along the drill string 11 (FIG. 1). Additionally or alternatively, the signal relay devices may be included in wellbore equipment, such as a casing 17 (FIG. 1). Illustrative wellbore equipment, include, but are not limited to, casings, liners, casing collars, casing shoes, devices embedded in the formation, conduits (e.g., hydraulic tubing, electrical cables, pipes, etc.). The downhole communication link may also include a signal carrier 66 disposed along the non-rigid carrier 16 or the rigid tubulars 14 commonly referred to as wired pipe in the drill string 11. The signal carrier 66 may be metal wire, optical fibers, customized cement or any other suitable carrier for conveying information-containing signals. The signal carrier 66 may be embedded in the wall of the non-rigid section 16, the rigid tubulars 14, or the casing 17, or disposed in any wellbore equipment at the surface or downhole. The signal carrier 66 may also be fixed inside or outside of the non-rigid section 16, the rigid tubulars 14, or the casing 17. The signals may be transmitted between the signal carrier 66 and the signal relay devices 60 using a suitably configured connector 70. Another connector 70 that may also house electronics, communication modules and processing equipment to exchange signals between the carrier 66 and the signal relay devices 60 may form a physical connection between the rigid section 14 and the non-rigid section 16.

In some embodiments, signal exchange speed and bandwidth can be enhanced by continuous system analysis and consequent shift to the best fit configuration channel selection by the system (pre-programmed and autonomous) and the use of Ultimate Radio System Extension Lines (URSEL). An illustrative URSEL system may be already installed at the rig site and/or installed into the wellbore. For example, a signal carrier such as a fiber optic wire may be embedded in the cement used to set casing 17. The wellbore construction equipped with signal exchange equipment/modules as mentioned may use the embedded signal carrier to transmit and receive information-bearing signals. In embodiments, radio over fiber (RoF) technology may be used to transmit information. RoF technology modulates light by radio signal and transmits the modulated light over an optical fiber. Thus, RF signals may be converted to light signals that are conveyed over fiber optic wires for a distance and then converted back to RF signals.

At the surface, the communication system 200 includes a controller 202 in signal communication with the signal relay devices 60. The controller 202 may include suitable equipment such as a transceiver 204 to wirelessly communicate with the signal relay devices 60 using EM or RF waves 206. This system 200 allows continuous communication while drilling and making and breaking jointed connections. The same RF transmitter or transceiver might be used for rig site and down hole transmission of the signals to reduce the complexity of the used equipment. Signal shape and strength might be adjusted depending on operational environment only.

The communication system 200 may be used to exchange information with the sensors and devices at the BHA 20 or positioned elsewhere on the string 11. Illustrative sensors include, but are not limited to, sensors for estimating: annulus pressure, drill string bore pressure, flow rate, near-bit direction (e.g., BHA azimuth and inclination, BHA coordinates, etc.), temperature, vibration/dynamics, RPM, weight on bit, whirl, radial displacement, stick-slip, torque, shock, strain, stress, bending moment, bit bounce, axial thrust, friction and radial thrust as well as formation evaluation sensors such as gamma radiation sensors, acoustic sensors, resistivity or permittivity sensors, NMR sensors, pressure testing tools and sampling or coring tools. Illustrative devices include, but are not limited to, the following: one or memory modules and a battery pack module to store and provide back-up electric power, an information processing device that processes the data collected by the sensors, and a bidirectional data communication and power module ("BCPM") that transmits control signals between the BHA 20 and the surface as well as supplies electrical power to the BHA 20. The BHA 20 may also include processors programmed with instructions that can generate command signals to operate other downhole wellbore equipment. The commands may be generated using the measurements from downhole sensors such as pressure sensors.

Based on information obtained using the communication system 200, the system 10 may be used to control out-of-norm wellbore conditions using well control equipment positioned in the wellbore 13. The well control equipment may include an annulus flow restriction device 222 that hydraulically isolates one or more sections of a wellbore by selectively blocking fluid flow in the annulus 37, a bore flow restriction device 224 that selectively blocks fluid flow along a bore 15 of the drill string 11, and a bypass valve 250.

The annulus flow restriction device 222 may be positioned along an uphole section of a non-rigid section 16 or anywhere else along the drill string 11. In one embodiment, the annulus flow restriction device 222 may form a continuous circumferential seal against a wellbore wall that controls flow in the well annulus 37. The terms seals, packers and valves are used herein interchangeably to refer to flow control devices that can selectively control flow across a fluid path by increasing or decreasing a cross-sectional flow area. The control can include providing substantially unrestricted flow, substantially blocked flow, and providing an intermediate flow regime. The intermediate flow regimes are often referred to as "choking" or "throttling," which can vary pressure in the annulus downhole of the annulus flow restriction device 222. The fluid barrier provided by these devices can be "zero leakage" or allow some controlled fluid leakage. In some embodiments, the seals and valves may include suitable electronics in order to be responsive to control signals. Suitable flow control devices include packer-type devices, expandable seals, solenoid operated valves, hydraulically actuated devices, and electrically activated devices.

Figure 4:
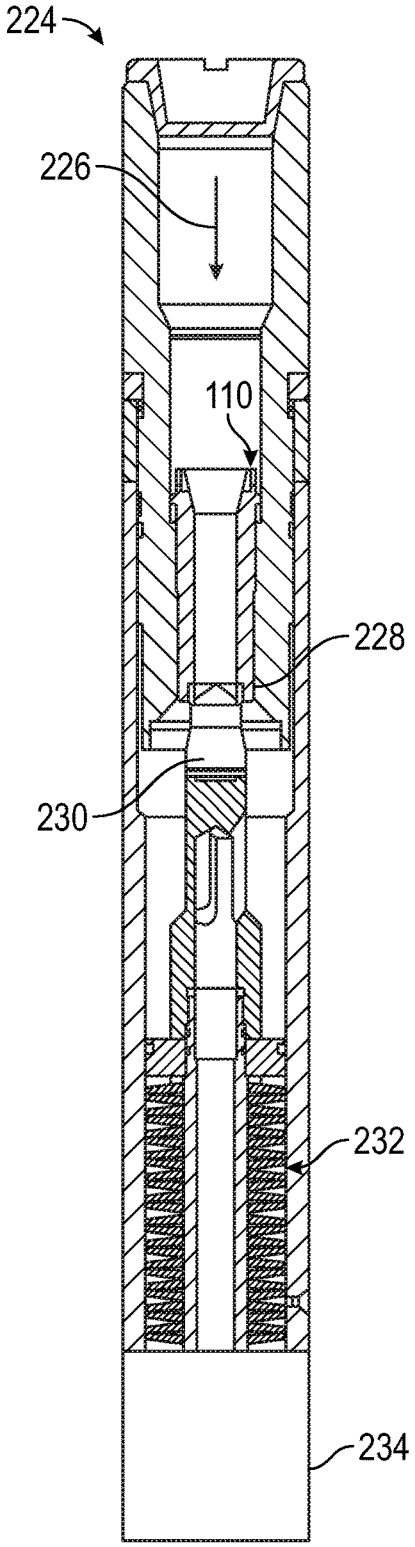
FIG. 4 schematically illustrates a bore flow restriction device that may be used with the FIG. 1 system.

Referring to FIG. 1, the bore flow restriction device 224 may be at the uphole end of a non-rigid section 16. Alternatively or additionally, the bore flow restriction device 224 may be positioned in the rigid section 14 of the drill string 11. Referring now to FIG. 4, the bore flow restriction device 224 may include a flow path 226, a sealing member 228, a closure member 230, a biasing member 232, and a signal responsive actuator 234. The sealing member 228 and the closure member 230 may be complementary in shape such that engagement forms a fluid-tight seal along the flow path 226. The biasing member 232 is configured to bias the closure member 230 toward and against the sealing member 230. In one embodiment, the biasing member 232 may include spring members (e.g., disk springs or coil springs). The spring force of the biasing member 232 may be selected such that a preset value or range of flow rates or pressure will overcome the spring force and keep the closure member 230 in the open, unsealed position. A drop in flow rate or pressure below the range allows the biasing member 232 to urge the closure member 230 into sealing engagement with the sealing member 228 (the closed position). Thus, the bore flow restriction device 224 may be configured to close in response to an interruption in fluid flow and/or a backflow condition. A backflow condition may arise with the bore pressure downhole of the bore flow restriction device 224 is greater than the uphole bore pressure.

The signal responsive actuator 234 allows the bore flow restriction device 224 to be remotely actuated with a control signal. The signal may be transmitted from the surface and/or from a device located in the wellbore 13 (e.g., the BHA 20). For instance, the controller 202 (FIG. 1) may transmit a control signal to instruct the bore flow restriction device 224 to open, close, or shift to an intermediate position. The signal response actuator 234 may be a hydraulic, electric, or mechanical device that can shift the closure member 230 into engagement with the sealing member 228 in response to a control signal. The actuator 234 may include suitable electronics to process the control signals and initiate the desired actions. Like the annulus flow restriction device 222, the bore flow restriction device 224 may either completely seal the bore or partially block fluid flow in the bore.

The closure member 230 may be a bypass valve that is configured to direct flow between the annulus 37 and the bore 15 of the drill string 11. Like the flow restriction devices 222, 224, the closure member 230 may include a signal response actuator 234 that can shift the closure member 230 between an open position, a closed position, and/or an intermediate position. The signal response actuator 234 may include suitable electronics to receive and process the control signals and to initiate the desired actions.

In embodiments, communication using mud pulses may be enabled by distributing pressure sensors at selected surface locations within the continuous circulation system 100 and/or downhole locations; e.g., at the signal relay device 60 or in the bottomhole assembly 20. The communication may be in one direction or bi-directional. Such a system allows continuous communication while drilling and making and breaking jointed connections. Non-limiting embodiments having such functionality are described below.

Referring to FIGS. 1-2, in one embodiment, one or more pressure transducers may be hydraulically connected to the flow lines of the continuous circulation system 100. For instance, a first pressure transducer 251 may be in pressure communication with the line 36 supplying drilling fluid to the flow diverter 30 and a second pressure transducer 252 may be positioned along a flow line 36 (not shown) supplying drilling fluid to the top drive 24. Thus, the first and second pressure transducer 251, 252 may detect pressure signals conveyed along the fluid column inside the drill string 11. Additionally, a third pressure transducer 253 may be positioned to be in fluid communication with the drilling fluid in the fluid annulus 37 surrounding the drill string 11. Thus, the third pressure transducer 253 may server as a reference pressure or may detect pressure signals conveyed along the fluid column in the annulus 37. The hydraulic connection or pressure communication should be sufficient to allow the transfer of pressure pulses or waves.

Referring to FIG. 3, the signal relay device 60 may include a fourth pressure transducer 254 in pressure communication with the bore 120 and a fifth pressure transducer 256 in pressure communication with the exterior of the signal relay device 60. Thus, the fourth pressure transducer 254 may detect pressure signals conveyed along the fluid column inside the drill string 11 and the fifth pressure transducer 256 may detect pressure signals conveyed along the fluid column in the annulus 37 surrounding the drill string 11. Similarly, pressure transducers may be included elsewhere in the drill string 11 (e.g. in the BHA 20) or in other downhole or surface equipment.

Referring to FIGS. 1-3, the pressure signals or pulses detected by the transducers 251-254, 256 may be generated by a signal generator located at one or more surface and/or downhole locations. A signal generator is any device that can produce one or more discernible pressure waves having a defined characteristic such as a shape, frequency, and/or magnitude. Signal generators may use vibrating elements or change a flow parameter (e.g., flow rate). Illustrative non-limiting signal generators include bypass valves, mud pulsers, sirens, vibrators, etc. The pressure pulses created by the signal generator can be considered encoded signals because the signals are transmitted in a manner that conveys information between two locations. This information may be data such as sensor readings, command signals, alarms, etc.

In one arrangement, at the surface, a pulse wave generator 260 may be used to impart pressure pulses 262 into the drilling fluid flowing in the annulus 37. In other embodiments, the signal generator may be a valve (not shown) at the manifold 102 that imparts pressure pulses into the fluid flowing through the bore of the drill string 11. A signal generator (not shown) could also be positioned at the top drive 24, the pump (not shown) flowing fluid from the mud source 38, or any location along the mud flow path. At a downhole location, pressure pulses may be generated by the upper or lower circulation valves 114, 116 of one or more signal relay devices 60, the annulus flow restriction device 222, and/or the bore flow restriction devices 224. Downhole pressure pulses may also be generated using signal generators (not shown) such as bypass valves, mud pulser, or sirens in the BHA 20.

Referring to FIGS. 1-3, the pressure transducers 251, 252, 253 may be connected in parallel to the controller 202 of the communication system 200. Additionally, the controller 202 may be in signal communication (not shown) with pressure transducers 254, 256 embedded in the signal relay devices 60 or may be included elsewhere in the downhole equipment. As discussed previously, the controller 202 may include suitable equipment such as electrical or fiber optic wires, or the transceiver 204 to wirelessly communicate with the signal relay devices 60 using the EM or RF waves 206. The same RF transmitter or transceiver may be used for rig site and downhole transmission of the signals to reduce the complexity of the equipment. Signal shape and strength might be adjusted depending on operational environment.

Referring now to FIGS. 1-4, exemplary modes of use of the system 10 will be discussed. To begin, the non-rigid section 16 may be used to convey the BHA 20 into the wellbore 13. It should be noted that the drill string 11 does not require the non-rigid section 16. However, use of the non-rigid section 16 may reduce the number of pipe stands 12*a* and flow diverters 30 required to reach a desired target depth. When desired, the rigid section 14 may be connected to the non-rigid section 16 with the connector 70. Thereafter, the flow diverters 30 may be used to interconnect the sections of pipe 12*a* used to form the rigid section 14. As successive pipe joints 12*a* are added to the rigid section 14, the CCS 100 maintains a continuous flow of drilling fluid along the drill string 11. Thus, the pressure applied to the formation remains relatively constant or can be managed within a desired range. During drilling with the BHA 20, the drill bit 50 may be rotated by one or more of the downhole motor 28, the rotary power device 26 positioned at the connector 70, and the top drive 24.

As drilling progresses, the signal generator(s) and pressure transducer(s) cooperate to form communication links that operate even when the drill string 11 is broken; i.e., a pipe stand 12 is physically separated from the drill string 11. For example, the signal generators downhole and/or at the surface may transmit pressure pulses that flow along the fluid column inside the drill string 11 and/or in the annulus 37.

Communication uplinks, i.e., transmitting information to the surface, may be accomplished by using the pressure transducers 251, 252, 253 to detect pressure pulses generated by downhole signal generators.

Communication downlinks, i.e., transmitting information to a downhole location, may be accomplished by using the pressure transducers 254, 256 to detect pressure pulses generated by surface signal generators. In embodiments where the flow diverters 30 may not include pressure transducers, communication downlinks can be sent to pressure transducers (not shown) in the BHA 20 or elsewhere in the drill string 11.

Communication between two downhole locations may be accomplished by using the pressure transducers 254, 256 of one signal relay device 60 and a signal generator of another signal relay device or a signal generator or pressure transducer located elsewhere along the drill string 11 (e.g., a mud pulser, a bypass valve, a siren, or a pressure transducer at the BHA 20).

It should be appreciated that the mud pulse signal communication is not interrupted when pipe 12*a* is added to or removed from the drill string 11. During such disconnections, drilling mud is still circulating even though a pipe stand is physically decoupled from the drill string 11, which enables mud pulse signals to be conveyed between the surface and downhole. Therefore, the pressure transducers 251-254, 256, which are in communication with the circulating mud, can detect pressure signals imparted to the flowing fluid. As a result, communication uplinks and downlinks are maintained throughout the disconnections. Stated differently, the communication links convey information between at least two locations along a flow path of the circulating drilling fluid irrespective whether the CCS 100 selects a first fluid path through the top drive the drill string or a second fluid path through the flow diverter to convey the fluid into the drill string.

In one variant, the system 10 may utilize reverse circulation. During reverse circulation, the drilling mud is pumped into the annulus 37. The drilling mud and entrained cuttings return via a bore of the drill string 11. In this mode of circulation also, the instrumentation described above enables uninterrupted uni-directional or bi-direction communication via mud pulses. It should be understood that reverse circulation itself may have variants. For example, crossover subs may divert annulus flow into the drill string bore 15 while diverting drill string flow into the annulus. Thus, flow may be "reverse" in some sections of the well but "conventional" in other parts of the well.

One advantage of uninterrupted communication is that pressure information may be continuously transmitted by the communication system 200 or the mud pulse telemetry. Therefore, pressure adjustments may be done in real time or near-real time. Advantageously, deep drilling situations that have tight pressure windows and formations with changing formation pressure may be managed more efficiently because wellbore pressure management devices can be rapidly and accurately adjusted. Additionally, this enhanced control may enable drilling to be performed while the well is in an underbalanced pressure condition. In many instances, drilling in an underbalanced condition yields enhanced rates of penetration.

In other instances, the pressure information may indicate that corrective action may be needed to contain an undesirable condition. For example, the pressure information received may indicate that an enhanced risk for a potential "kick," or pressure spike exists. One exemplary response may include the controller 202 transmitting a control signal using the communication system 200 to the annular flow restriction device 222. In response, the annular flow restriction device 222 may radially expand and seal against the adjacent wellbore wall. Thus, the fluid annulus 37 of the wellbore 13 downhole of the flow restriction device 222 may hydraulically isolated from the remainder of the wellbore 13. Additionally or alternatively, the controller 202 may send a control signal to the bore flow restriction device 224. In response, the bore flow restriction device 224 may seal the bore of the drill string 11. Thus, the bore of the drill string 11 downhole of the flow restriction device 224 may hydraulically isolated. The actuation of either or both of the flow restriction devices 222, 224 in this manner may isolate the downhole section of the wellbore 13 and thereby reduce the risk of the pressure kick.

After the wellbore has been isolated, remedial action may be taken such as bleeding off the pressure kick, increasing mud weight, etc. In other instances, it may be desired to isolate the wellbore either temporarily or permanently. Isolating the wellbore may be done by leaving the entire drill string 11 in the wellbore 13. Alternatively, the rigid section 14 may be disconnected from the non-rigid section 16 and pulled out the wellbore 13. Thus, the wellbore 13 is isolated by the non-rigid section 16 and the flow restriction devices 222, 224.

While the above modes have used surface initiated actions, it should be understood that the BHA 20 may use one or more downhole controllers that are programmed to also monitor pressure conditions, determine whether an undesirable condition exists, and transmit the necessary control signals to the flow restriction devices 222, 224, bypass valve 250, and/or other equipment. These actions may be taken autonomously or semi-autonomously.

The present disclosure is not limited to a particular drilling configuration. For instance, the BHA 20 may include devices that enhance drilling efficiency or allow for directional drilling. For instance, the BHA 20 may include a thruster that applies a thrust to urge the drill bit 50 against a wellbore bottom. In this instance, the thrust functions as the weight-on-bit (WOB) that would often be created by the weight of the drill string. It should be appreciated that generating the WOB using the thruster reduces the compressive forces applied to the non-rigid section 16. One or more stabilizers that may be selectively clamped to the wall may be configured to have thrust-bearing capabilities to take up the reaction forces caused by the thruster. Moreover, the thruster allows for drilling in non-vertical wellbore trajectories where there may be insufficient WOB to keep the drill bit 50 pressed against the wellbore bottom. Some embodiments of the BHA 20 may also include a steering device. Suitable steering arrangements may include, but are not limited to, bent subs, drilling motors with bent housings, selectively eccentric inflatable stabilizers, a pad-type steering devices that apply force to a wellbore wall, "point the bit" steering systems, etc. As discussed previously, stabilizers may be used to stabilize and strengthen the sections 14, 16.

In other instances, the drill string 11 may be used for non-drilling activities such as casing installation, liner installation, casing/liner expansion, well perforation, fracturing, gravel packing, acid washing, tool installation or removal, etc. In such configurations, the drill bit 50 may not be present.

From the above, it should be appreciated from the discussion below, aspects of the present disclosure provide a system for deep drilling (e.g., tight pressure windows) and drilling into formations with changing formation pressure (e.g., depleted zones). Systems according to the present disclosure provide ECD control (equivalent circulating density control) for such situations. These systems may allow the exploration and production of deep high enthalpy geothermal energy due to the ability to manage tight pressure windows in deep crystalline rock.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. A system for performing a wellbore operation while a fluid circulates in a wellbore, comprising:

a string comprising at least a first tubular section and a second tubular section, each tubular section configured to be disconnected from the string;

a fluid circulating system circulating fluid through at least a part of the string;

a continuous circulation device comprising at least a first fluid path and a second fluid path, wherein only one of the first fluid path and the second fluid path circulate the fluid into the string at a specified time;

a control device configured to select one of the first and second fluid path through which to convey the fluid into the string;

at least one signal generator in hydraulic communication with the circulating fluid, the at least one signal generator configured to impart at least one pressure signal into the circulating fluid, the at least one signal generator is positioned at a location selected from one of: (i) in an annulus of the wellbore to generate at least one pressure pulse into the annulus, (ii) at a manifold of the continuous circulation device, and (iii) at a pump associated with a fluid source; and at least one pressure transducer in pressure communication with the circulating fluid and configured to detect the imparted at least one pressure signal, and;

a flow diverter positioned along the string, the flow diverter including the at least one pressure transducer;

wherein the at least one signal generator and the at least one pressure transducer form a communication link configured to convey information between at least two locations along a flow path of the circulating drilling fluid, irrespective whether the first fluid path or the second fluid path is selected by the control device to convey the fluid into the drill string.

2. The system of claim 1, wherein the at least one signal generator is positioned at a surface location and wherein the at least one pressure transducer is positioned along the string, wherein the at least one signal generator impart the at least one pressure pulse into fluid flowing into an annulus of the wellbore.

3. The system of claim 1, wherein the communication link is bi-directional.

4. The system of claim 1, wherein the at least one signal generator further includes at least a second signal generator positioned on the drill string.

5. A system for performing a wellbore operation while a fluid circulates in a wellbore, comprising:

a string comprising at least a first tubular section and a second tubular section, each tubular section configured to be disconnected from the string;

a fluid circulating system circulating fluid through at least a part of the string;

a continuous circulation device comprising at least a first fluid path and a second fluid path, wherein only one of the first fluid path and the second fluid path circulate the fluid into the string at a specified time;

a control device configured to select one of the first and second fluid path through which to convey the fluid into the string;

at least one signal generator in hydraulic communication with the circulating fluid, the at least one signal generator configured to impart at least one pressure signal into the circulating fluid; and at least one pressure transducer in pressure communication with the circulating fluid and configured to detect the imparted at least one pressure signal, wherein the at least one signal generator and the at least one pressure transducer form a communication link, the communication link configured to convey information between at least two locations along a flow path of the circulating drilling fluid, irrespective whether the first fluid path or the second fluid path is selected by the control device to convey the fluid into the drill string, wherein the at least one signal generator is positioned along the drill string, and wherein the at least one pressure transducer is in hydraulic communication with an annulus surrounding the drill string.

6. A system for performing a wellbore operation while a fluid circulates in a wellbore, comprising:

a string comprising at least a first tubular section and a second tubular section, each tubular section configured to be disconnected from the string;

a fluid circulating system circulating fluid through at least a part of the string;

a continuous circulation device comprising at least a first fluid path and a second fluid path, wherein only one of the first fluid path and the second fluid path circulate the fluid into the string at a specified time;

a control device configured to select one of the first and second fluid path through which to convey the fluid into the string;

at least one signal generator in hydraulic communication with the circulating fluid, the at least one signal generator configured to impart at least one pressure signal into the circulating fluid; and at least one pressure transducer in pressure communication with the circulating fluid and configured to detect the imparted at least one pressure signal, wherein the at least one signal generator and the at least one pressure transducer form a communication link, the communication link configured to convey information between at least two locations along a flow path of the circulating drilling fluid, irrespective whether the first fluid path or the second fluid path is selected by the control device to convey the fluid into the drill string, wherein the at least one signal generator is positioned along the drill string, and wherein the at least one pressure transducer is in hydraulic communication with at least one of: (i) the first fluid path, and (ii) the second fluid path.

7. A method for performing a wellbore operation while a fluid circulates in a wellbore, comprising:

conveying a string into the wellbore, the string comprising at least a first tubular section and a second tubular section, each tubular section configured to be disconnected from the string;

circulating fluid through at least a part of the string using a fluid circulating system, wherein the fluid circulation system includes a continuous circulation device comprising at least a first fluid path and a second fluid path, wherein only one of the first fluid path and the second fluid path circulate the fluid into the string at a specified time;

selecting one of the first and second fluid path through which to convey the fluid into the string using a control device;

imparting at least one pressure signal into the circulating fluid using at least one signal generator in hydraulic communication with the circulating fluid; and detecting the imparted at least one pressure signal using at least one pressure transducer in pressure communication with the circulating fluid, wherein the at least one signal generator and the at least one pressure transducer form a communication link, the communication link configured to convey information between at least two locations along a flow path of the circulating drilling fluid, irrespective whether the first fluid path or the second fluid path is selected by the control device to convey the fluid into the drill string, wherein the at least one pressure transducer is in hydraulic communication with at least one of: (i) the first fluid path, and (ii) the second fluid path.

8. The method of claim 7, wherein the at least one signal generator is positioned at a surface location and wherein the at least one pressure transducer is positioned along the string.

9. The method of claim 7, further comprising:

controlling flow into the string using a flow diverter positioned along the string, the flow diverter having the at least one pressure transducer.

10. The method of claim 7, wherein the at least one pressure transducer is positioned in a bottomhole assembly included into the string.

11. The method of claim 7, wherein the at least one signal generator is positioned along the drill string.

12. The method of claim 11, wherein the at least one pressure transducer is in hydraulic communication with an annulus surrounding the drill string.

13. A system for performing a wellbore operation while a fluid circulates in a wellbore, comprising:

a string comprising at least a first tubular section and a second tubular section, each tubular section configured to be disconnected from the string;

a fluid circulating system circulating fluid through at least a part of the string;

a continuous circulation device comprising at least a first fluid path and a second fluid path, wherein only one of the first fluid path and the second fluid path circulate the fluid into the string at a specified time;

a control device configured to select one of the first and second fluid path through which to convey the fluid into the string;

at least one signal generator in hydraulic communication with the circulating fluid, the at least one signal generator configured to impart at least one pressure signal into the circulating fluid; and at least one pressure transducer in pressure communication with the circulating fluid and configured to detect the imparted at least one pressure signal, wherein the at least one signal generator and the at least one pressure transducer form a communication link, the communication link configured to convey information between at least two locations along a flow path of the circulating drilling fluid, irrespective whether the first fluid path or the second fluid path is selected by the control device to convey the fluid into the drill string, wherein the at least one pressure transducer includes at least one of: (i) a pressure transducer in pressure communication with a line supplying fluid to a flow diverter positioned along the string, and (ii) a transducer positioned along a flow line supplying fluid to a top drive coupled to the string.

* * * * *